US008252160B2

(12) United States Patent
Harding

(10) Patent No.: US 8,252,160 B2
(45) Date of Patent: Aug. 28, 2012

(54) PREVENTION OF FLUID DELIVERED TO RESERVOIR FROM WICKING INTO CHANNELS WITHIN MICROFLUIDIC DEVICE

(75) Inventor: Philip Harding, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1800 days.

(21) Appl. No.: 11/460,627

(22) Filed: Jul. 28, 2006

(65) Prior Publication Data

US 2008/0025873 A1 Jan. 31, 2008

(51) Int. Cl.
*B01L 3/00* (2006.01)

(52) U.S. Cl. ..... 204/500

(58) Field of Classification Search ..... 422/100, 422/500

See application file for complete search history.

(56) References Cited

U.S. PATENT DOCUMENTS

| | | | | |
|---|---|---|---|---|
| 5,971,158 | A | 10/1999 | Yager et al. | |
| 6,090,251 | A | 7/2000 | Sundberg et al. | |
| 6,482,364 | B2 | 11/2002 | Parce et al. | |
| 6,681,788 | B2 | 1/2004 | Parce et al. | |
| 6,695,009 | B2 | 2/2004 | Chien et al. | |
| 6,695,147 | B1 | 2/2004 | Yager et al. | |
| 6,779,559 | B2 | 8/2004 | Parce et al. | |
| 7,028,536 | B2 | 4/2006 | Karp et al. | |
| 7,033,474 | B1 | 4/2006 | Dubrow et al. | |
| 7,059,352 | B2 | 6/2006 | Bohm | |
| 2002/0008028 | A1 | 1/2002 | Jacobsen et al. | |
| 2002/0150502 | A1 | 10/2002 | Weigl | |
| 2004/0022681 | A1 | 2/2004 | Hantschel et al. | |
| 2004/0121450 | A1 | 6/2004 | Pugia et al. | |
| 2006/0264779 | A1 * | 11/2006 | Kemp et al. | 600/583 |

FOREIGN PATENT DOCUMENTS

WO WO 9933559 A1 * 7/1999

* cited by examiner

*Primary Examiner* — Bobby Ramdhanie

(57) ABSTRACT

A microfluidic device includes a substrate and a non-valve capillary mechanism. At least a reservoir and one or more channels leading to the reservoir are formed within the substrate. The non-valve capillary mechanism is within the reservoir, and prevents fluid delivered to the reservoir from wicking from the reservoir into the channels.

20 Claims, 4 Drawing Sheets

PREVENTION OF FLUID DELIVERED TO RESERVOIR FROM WICKING INTO CHANNELS WITHIN MICROFLUIDIC DEVICE

BACKGROUND

Microfluidic devices are used for a variety of different purposes, such as assaying, so that less fluid is used and automation can be increased, both of which serve to decrease costs. A consequence of the smaller fluid volumes and the smaller channels and reservoirs within such microfluidic devices is the resulting domination of capillary, or surface tension, forces over the fluids deposited within the devices. As such, fluid delivered into a reservoir of a microfluidic device may undesirably wick into a connecting channel, resulting in lost reagent volume, contamination, and other problems. Existing approaches to resolve this issue typically employ passive (or capillary) valves, or active valves. However, the former type of valve at least occasionally fails, while the latter type of valve can be prohibitively expensive to incorporate within a microfluidic device.

DETAILED DESCRIPTION OF THE DRAWINGS

Figure 1:
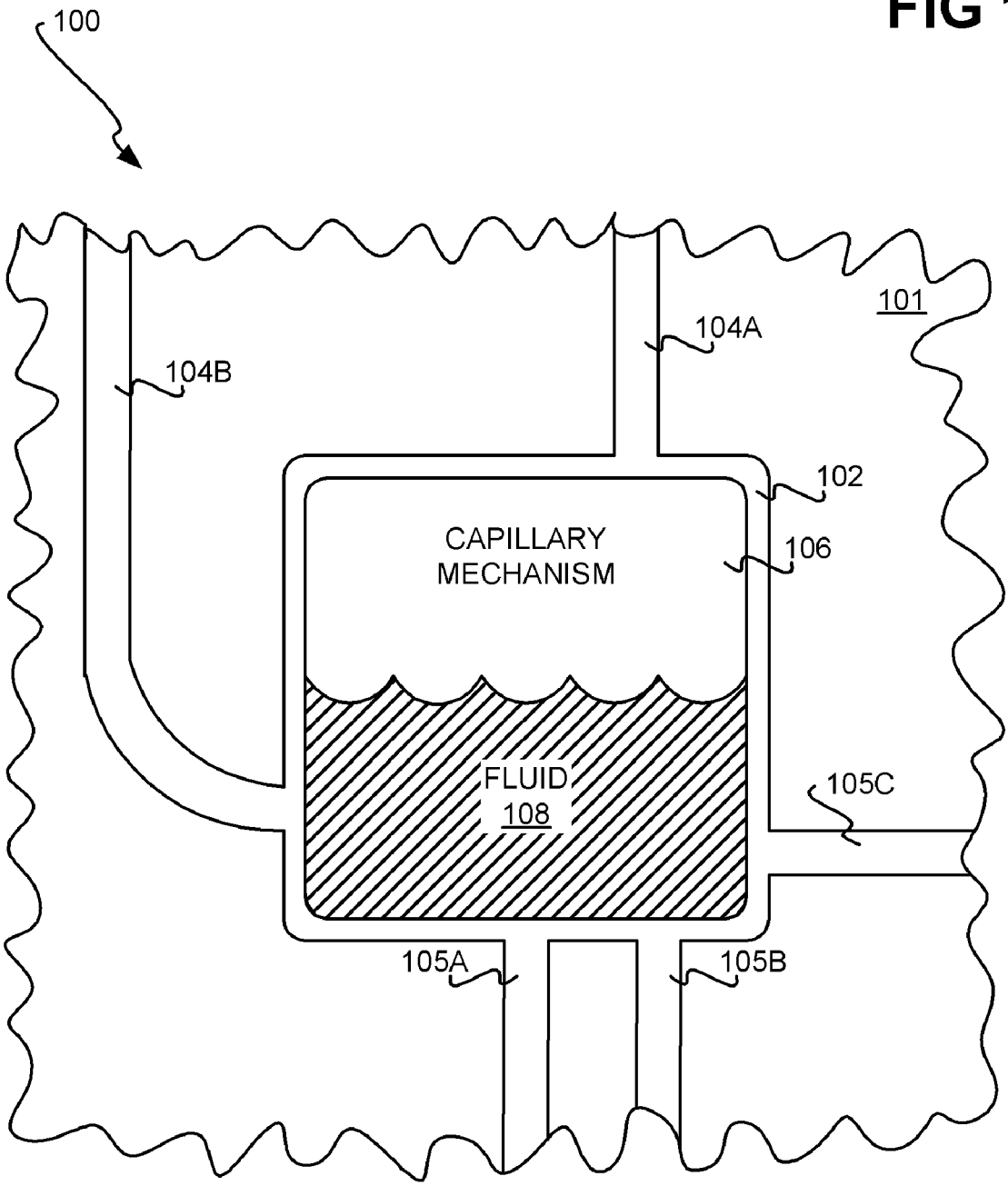
FIG. 1 is a diagram of a portion of a microfluidic device having a capillary mechanism to prevent fluid delivered to a reservoir of the device from undesirably wicking into channels of the device, according to an embodiment of the invention.

FIG. 1 shows a portion of a microfluidic device 100, according to an embodiment of the invention. The microfluidic device 100 may be any type of microfluidic device, such as a microfluidic coupon device employed for the analysis of a deposited biological or other sample by chemical assaying using a deposited reagent, an example of which is particularly described later in the detailed description. The microfluidic device 100 includes a substrate 101 within which at least a reservoir 102, and a number of channels 104A and 104B, collectively referred to as the channels 104, and a number of channels 105A, 105B, and 105C, collectively referred to as the channels 105 are formed. The channels 104 are inlet channels to deliver fluid 108 to the reservoir 102, whereas the channels 105 are outlet channels to deliver the fluid 108 from the reservoir 102. The microfluidic device 100 further includes a capillary mechanism 106, the functionality and exemplary structure of which is described later in the detailed description.

The substrate 101 may be of a hydrophobic material at least at where the fluid 108 potentially comes into contact with the reservoir 102 and the channels 104 and 105. In one embodiment, the hydrophobic material of the reservoir 102 is identical to or the same as the hydrophobic material of the channels 104 and 105. An example of such a hydrophobic material is polytetrafluoroethylene (PTFE). The hydrophobic material ideally resists the attraction of the fluid 108, such that the fluid 108 does not adhere to the channels 104 and 105 after passing through the channels 104 and 105 to the reservoir 102. However, in actuality, at least some of the channels 104 and 105 retain at least a portion of the fluid 108 upon the fluid 108 passing through the channels 104 and 105, resulting in the channels 104 and 105 becoming at least partially hydrophilic.

Fluid 108, such as a biological sample, a reagent material, a combination thereof, or another type of fluid, is delivered to the reservoir 102 via the channels 104. For instance, the microfluidic device 100, particularly the substrate 101 thereof, may be rotatable and thus rotated, which causes the fluid 108 deposited elsewhere on the microfluidic device 100 to be delivered to the reservoir 102 through the channels 104, via centrifugal force. Upon delivery of the fluid 108 to the reservoir 102 and upon cessation of the rotation of the substrate 101, the fluid 108 is susceptible to undesirable wicking into or back into the channels 104 or into the channels 105 via capillary, or surface tension, forces. For instance, even where the channels 104 are hydrophobic in principle, as noted above, they may become at least partially hydrophilic upon the fluid 108 passing therethrough, increasing the likelihood of wicking action of the fluid 108 from the reservoir 102 back into the channels 104.

In one embodiment, subsequent and further rotation of the substrate 101 causes the fluid 108 that has been delivered to the reservoir 102 to exit the reservoir 102, via the channels 105. However, the channels 105 may not be present in all embodiments of the invention. As such an example, the reservoir 102 may be a waste reservoir that represents the final destination of the fluid 108, such that the fluid 108 is not delivered to any location once it has been delivered to the reservoir 102.

The capillary mechanism 106 is employed to prevent this undesirable wicking of the fluid 108 from the reservoir 102 into or back into the channels 104 and 105. Thus, the fluid 108 stays within the reservoir 102 after being delivered to the reservoir 102, such as through the channels 104, and does not migrate to the channels 104 and 105 via capillary, or surface tension, forces. In at least some embodiments, the capillary mechanism 106 is a non-valve mechanism. That is, in these embodiments, neither an active or passive valve is employed to prevent the fluid 108 from wicking from the reservoir 102 into the channels 104 and 105. An active valve may be a mechanical or electromechanical valve that employs pressure or another mechanism to prevent such wicking. A passive valve may be an immediate enlargement of a microfluidic channel to limit movement of fluid via capillary, or surface tension, forces.

Three different embodiments of the capillary mechanism 106 are now described. It is noted, however, that other embodiments of the invention may employ other types of the capillary mechanism 106. Furthermore, whereas the three embodiments of the capillary mechanism 106 are described separately and individually, each of them may be employed in combination with one or more of the other embodiments to realize the capillary mechanism 106, as can be appreciated by those of ordinary skill within the art.

Figure 2:
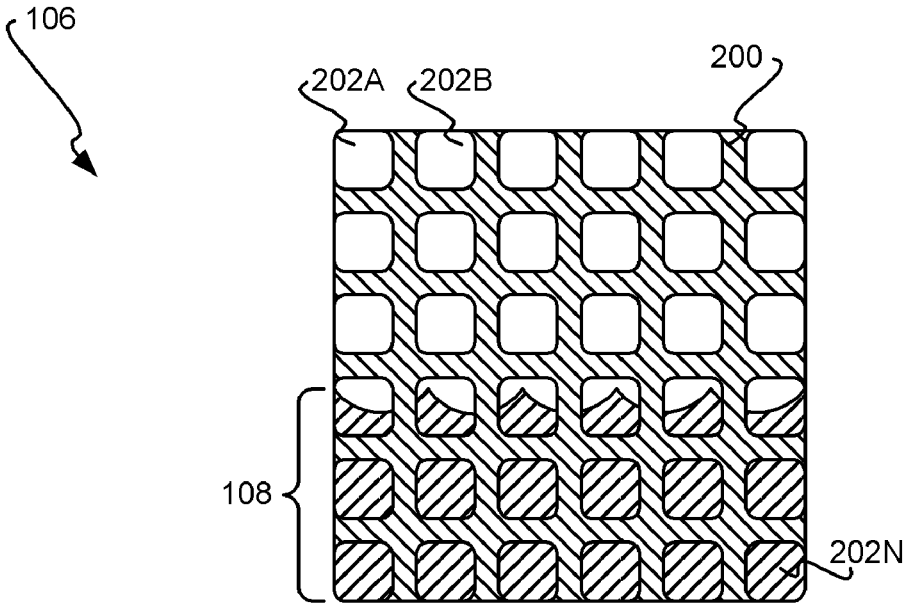
FIG. 2 is a diagram of a non-swelling capillary medium that can be employed as the capillary mechanism within the microfluidic device of FIG. 1, according to an embodiment of the invention.

FIG. 2 shows a non-swelling capillary medium 200 that may be employed as or as part of the capillary mechanism 106, according to an embodiment of the invention. The non-swelling capillary medium 200 has a mesh structure, or network, defining a number of interstices 202A, 202B, . . . , 202N, collectively referred to as the interstices 202. The medium 200 is an entity apart from the substrate 101 of the microfluidic device 100 itself, and is fixably or removably inserted into the reservoir 102 of the microfluidic device 100.

Upon delivery of the fluid 108 into the reservoir 102, the fluid 108 is hydrophilically attracted to and retained within the interstices 202 of the non-swelling capillary medium 200 by capillary, or surface tension, forces. As such, the fluid 108 retained within the interstices 202 is prevented from wicking from the reservoir 102 into the channels 104 and 105. As depicted in FIG. 2, the fluid 108 resides within a portion of the interstices 202, such that additional fluid 108 can be retained within the remaining portion of the interstices 202. The interstices 202 are sized smaller than the channels 104 and 105, so that capillary forces cause the fluid 108 to be attracted to and retained within the interstices 202 instead of the channels 104 and 105. A more formal description of these capillary forces is presented later in the detailed description.

The capillary medium 200 is non-swelling, in that substantially none of the of the fluid 108 is absorbed into the medium 200 itself, as opposed to into the interstices 202 defined by the medium 200. That is, the fluid 108 is substantially unabsorbed into the capillary medium 200 itself. The non-swelling capillary medium 200 may be a fiber mesh, such as paper or another type of cellulose material, and is highly hydrophilic, or wettable. While the mesh structure or network of the non-swelling capillary medium 200 is depicted as being in a grid formation, this is for example purposes only, and other types of mesh structures or networks may also be employed.

Figure 3:
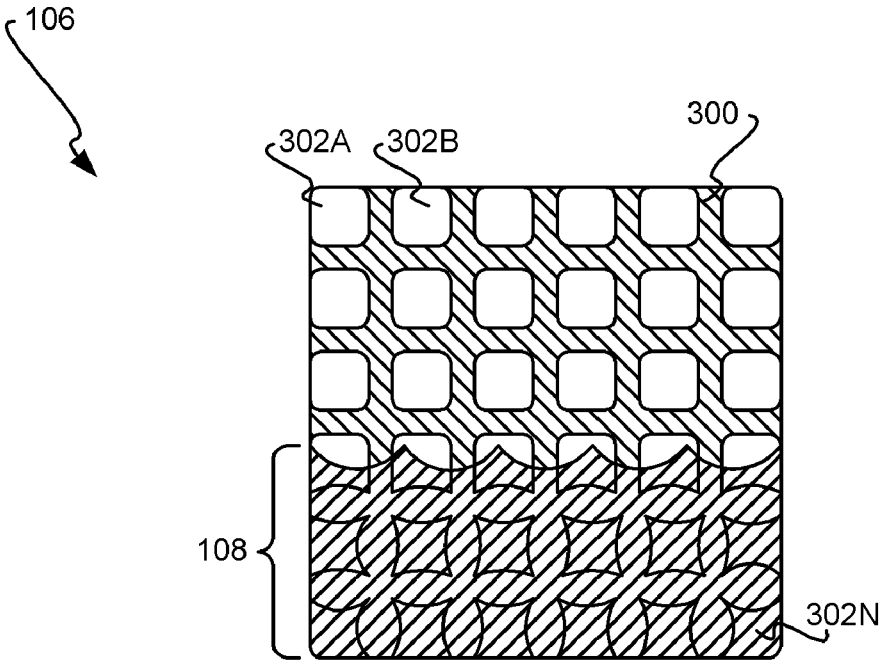
FIG. 3 is a diagram of a swelling capillary medium that can be employed as the capillary mechanism within the microfluidic device of FIG. 1, according to an embodiment of the invention.

FIG. 3 shows a swelling capillary medium 300 that may be employed as or part of the capillary mechanism 106, according to an embodiment of the invention. The swelling capillary medium 300 also has a mesh structure, or network, defining a number of interstices 302A, 302B, . . . , 302N, collectively referred to as the interstices 302. The medium 300 is also an entity apart from the substrate 101 of the microfluidic device 100 itself, and is fixably or removably inserted into the reservoir 102 of the microfluidic device 100.

Upon delivery of the fluid 108 into the reservoir 102, the fluid 108 is hydrophilically attracted to and retained within the interstices 302 of the swelling capillary medium 300 by capillary, or surface tension, forces. Furthermore, the fluid 108 is actually absorbed into the capillary medium 300 itself, such that the mesh of the medium 300 swells where it has absorbed the fluid 108. The fluid 108 absorbed within the swelling capillary medium 300 and retained within the interstices 302 thereof is prevented from wicking from the reservoir 102 into the channels 104 and 105. As depicted in FIG. 3, the fluid 108 resides within a portion of the interstices 302 and absorbed within a portion of the swelling capillary medium 300, such that additional fluid 108 can be retained within the remaining portion of the interstices 302 and absorbed within the remaining portion of the capillary medium 300. As with the interstices 202 of FIG. 2, the interstices 302 are sized smaller than the channels 104 and 105, so that capillary forces cause the fluid 108 to be attracted to and retained within the interstices 302 instead of the channels 104 and 105.

The capillary medium 300 is thus swelling in that the medium 300 itself absorbs at least some of the fluid 108 and resultingly swells, in addition to the interstices 302 attracting and retaining the fluid 108. The swelling capillary medium 300 may be a superabsorbent polymer material, such as the type commonly used to manufacture baby diapers. The medium 300 is further highly hydrophilic, or wettable. While the mesh structure or network of the swelling capillary medium 300 is depicted as being in a grid formation, this is for example purposes only, and other types of mesh structures or networks may also be employed.

Figure 4:
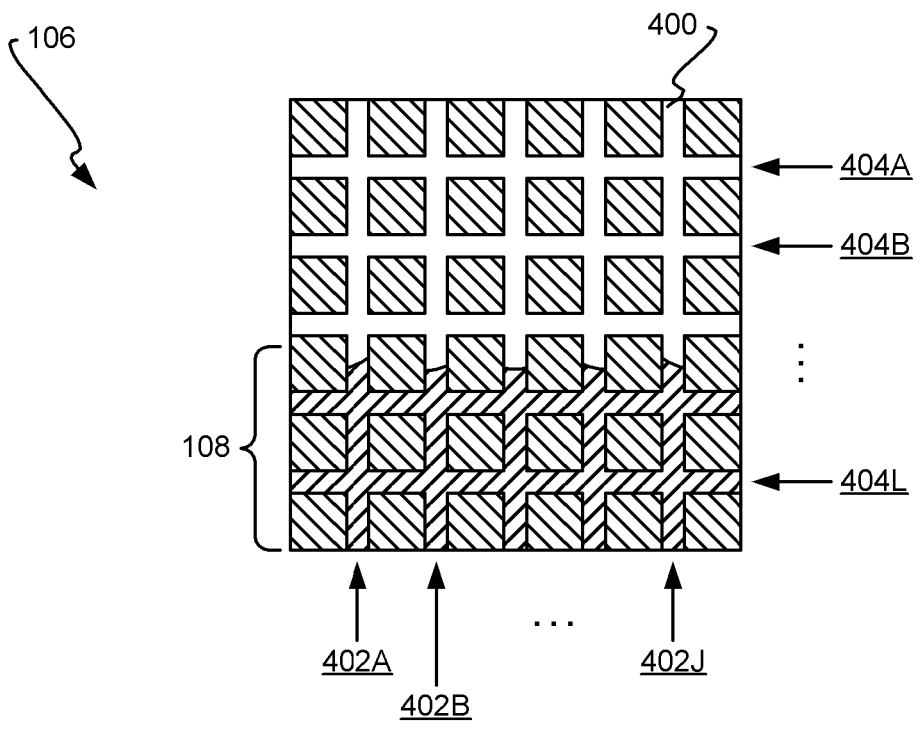
FIG. 4 is a diagram of a capillary network that can be employed as the capillary mechanism within the microfluidic device of FIG. 1, according to an embodiment of the invention.

FIG. 4 shows a number of capillaries 400 that may be employed as or as part of the capillary mechanism 106, according to an embodiment of the invention. The capillaries 400 are depicted as being organized over a number of columns 402A, 402B, . . . , 402J, and over a number of rows 404A, 404B, . . . , 404L. The capillaries 400 are fabricated within the substrate 101 of the microfluidic device 100 itself, and are not a separate entity apart from the substrate 101, in contradistinction to the capillary media 200 and 300 of FIGS. 2 and 3.

Upon delivery of the fluid 108 into the reservoir 102, the fluid 108 is hydrophilically attracted to and retained within the capillaries 400 by capillary, or surface tension, forces. As such, the fluid 108 retained within the capillaries 400 is prevented from wicking from the reservoir 102 into the channels 104 and 105. As depicted in FIG. 4, the fluid 108 resides within a portion of the capillaries 400, such that additional fluid can be retained within the remaining portion of the capillaries 400. The capillaries 400 may further be referred to as interstices in one embodiment of the invention. The capillaries 400 are sized smaller than the channels 104 and 105, so that capillary forces cause the fluid 108 to be attracted to and retained within the capillaries 400 instead of the channels 104 and 105.

A formal description of these capillary forces that cause the fluid 108 to be attracted to and retained within the interstices 202 and 302 of the capillary media 200 and 300 of FIGS. 2 and 3 and within the capillaries 400 of FIG. 4 is now presented. The Young-LaPlace equation known within the art specifies that:

$$\Delta P = \frac{2\sigma\cos\theta}{r_{eq}}.$$

In this equation, ΔP is capillary pressure, σ is the liquid surface tension, θ is the contact angle that the fluid 108 makes with the capillary mechanism 106, and $r_{eq}$ is the effective capillary radius of the capillary mechanism 106. For a given combination of fluid 108 and the material from which the substrate 101 of the microfluidic device 100 is fabricated, the capillary pressure ΔP holding the fluid 108 is related to the effective capillary radius $r_{eq}$ of the capillary mechanism 106 for a given capillary mechanism 106.

More specifically, the effective capillary radius $r_{eq}$ is directly related to the sizes of the interstices 202 and 302, or pores, within the capillary media 200 and 300 of FIGS. 2 and 3, and is directly related to the radii of the capillaries 400 of FIG. 4. As such, specification of the required retention pressure, which is dependent upon the material from which the substrate 101 of the microfluidic device 100 is fabricated and thus of the channels 104 and 105 and the reservoir 102, provides for specification of the needed properties for the capillary mechanism 106. In the case of the capillary media 200 and 300, these properties include the contact angle θ, and the sizes of the interstices 202 and 302. In the case of the capillaries 400, these properties include the contact angle θ, and the radii of the capillaries 400. The capillary pressure ΔP can be overcome via rotation, pumping, shaking, or any of a number of different ways for applying sufficient force.

Figure 5:
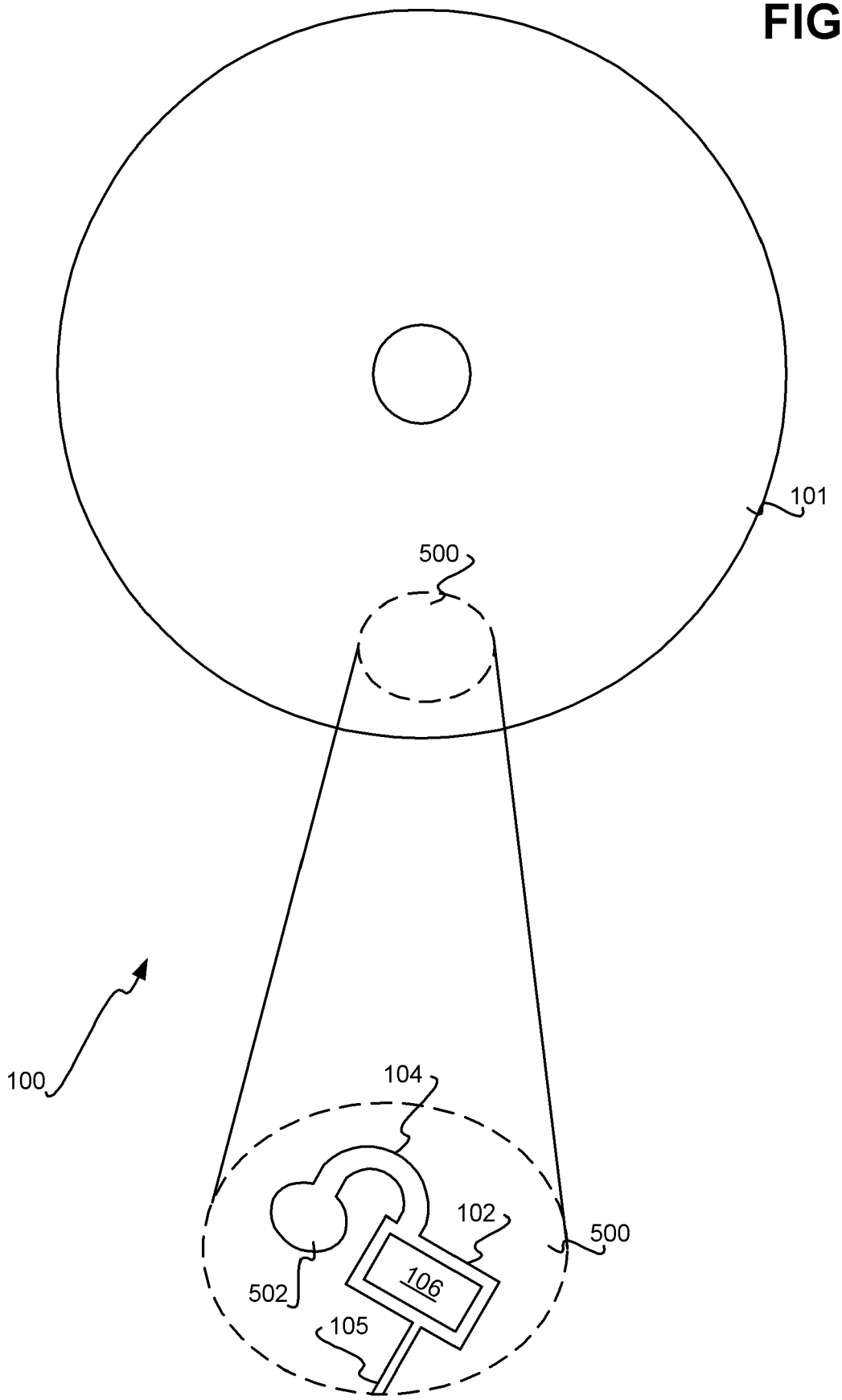
FIG. 5 is a diagram of a microfluidic coupon device, according to an embodiment of the invention.

FIG. 5 shows a partial representation of a particular type of microfluidic device 100, according to an embodiment of the invention. The microfluidic device 100 of FIG. 5 is a microfluidic coupon device that is used for analysis of a deposited sample via assaying of the sample with a reagent, as can be appreciated by those of ordinary skill within the art. A particular feature 500 of the microfluidic coupon device 100 is specifically highlighted in FIG. 5. As can also be appreciated by those of ordinary skill within the art, the microfluidic coupon device 100 of FIG. 5 can and typically does include other features besides the feature 500 shown in FIG. 5.

The feature 500 includes a reaction chamber 502 formed within the substrate 101, as well as the reservoir 102, which is particularly a waste reservoir, formed within the substrate 101 of the microfluidic coupon device 100. There may be more than one reaction chamber 502, and/or more than one reservoir 102. A network of channels, such as inlet channels 104 and the outlet channels 105, is further formed within the substrate 101 of the microfluidic device 100, and interconnects the reaction chamber 502 within the reservoir 102. More generally, the network of channels delivers the samples and/or the reagents to the reaction chamber 502 and to the waste reservoir 102. A reaction between the reagent and the sample can occur in the reaction chamber 502, such that the resulting reacted sample is then analyzed while in the chamber 502, as can be appreciated by those of ordinary skill within the art.

The microfluidic coupon device 100 is circular in shape, and is thus rotated to deliver the deposited sample and/or deposited the reagent on the device 100 to the reaction chamber 502 via centrifugal force. Excess sample and/or excess reagent is delivered from the reaction chamber 502 to the waste reservoir 102. The sample and/or the reagent may further be delivered to the waste reservoir 102 from other locations within the microfluidic coupon device 100. Furthermore, the sample and/or the reagent may subsequently be delivered from the reservoir 102 via the channels 105, where (additional) sufficient pressure is applied per the Young-LaPlace equation noted above, and where $\Delta P$ can be overcome in a variety of different ways as has been described. The microfluidic coupon device 100 includes the capillary mechanism 106, which prevents the samples and/or the reagents delivered to the waste reservoir 102 from wicking from the waste reservoir 102 back to the channels 104 or to the channels 105 upon cessation of the rotation of the device 100, as has already been described.

Figure 6:
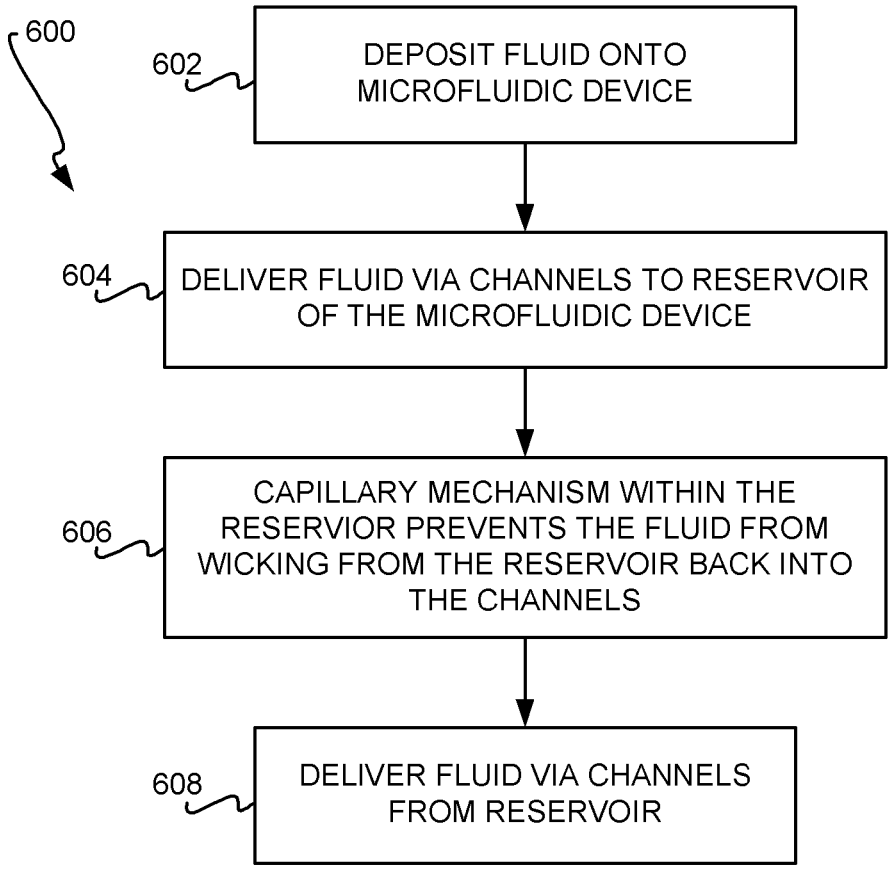
FIG. 6 is a flowchart of a method that can be employed in relation to the microfluidic device of FIG. 1 or the microfluidic coupon device of FIG. 5, according to an embodiment of the invention.

FIG. 6 shows a method 600 that can be performed in relation to the microfluidic device 100 that has been described, according to an embodiment of the invention. The fluid 108, such as a sample and/or a reagent, is deposited onto the microfluidic device 100 (602), which may be the microfluidic coupon device 100 of FIG. 5 that has been described. The fluid 108 is ultimately delivered by the inlet channels 104 to the reservoir 102 of the microfluidic device 100 (604). For instance, the microfluidic device 100 may be rotated, causing the fluid 108 to be so delivered via centrifugal force. The capillary mechanism 106 within the reservoir 102 thus prevents the fluid 108 from wicking from the reservoir 102 back into the channels 104 or into the channels 105 (606), as has also been described. The fluid 108 may in one embodiment also be delivered from the reservoir 102 via the outlet channels 105 (608), such as by further rotation of the microfluidic device 100.

I claim:

1. A microfluidic device comprising:

a substrate having formed therein at least a reservoir to which one or more channels lead; and, a non-valve backflow-prevention mechanism within the reservoir to prevent fluid delivered to the reservoir via the channels from flowing back from the reservoir into the channels, the non-valve backflow-prevention mechanism comprising a capillary medium.

2. The microfluidic device of claim 1, wherein the capillary medium comprises a non-swelling capillary medium apart from the substrate and inserted into the reservoir.

3. The microfluidic device of claim 2, wherein the non-swelling capillary medium comprises a plurality of interstices smaller in relation to the channels, the fluid retained within the interstices of the medium inserted into the reservoir such that the fluid is prevented from wicking from the reservoir into the channels, the fluid otherwise unabsorbed within the medium itself.

4. The microfluidic device of claim 1, wherein the capillary medium comprises a swelling capillary medium apart from the substrate and inserted into the reservoir.

5. The microfluidic device of claim 4, wherein the swelling capillary medium comprises a plurality of interstices smaller in relation to the channels, the fluid retained within the interstices of the medium inserted into the reservoir and absorbed within the medium itself such that the fluid is prevented from wicking from the reservoir into the channels.

6. The microfluidic device of claim 1, wherein the capillary medium comprises one or more capillaries fabricated within the substrate itself, the capillaries smaller in relation to the channels, the fluid retained within the capillaries of the mechanism such that the fluid is prevented from wicking from the reservoir into the channels.

7. The microfluidic device of claim 1, wherein the substrate is of a hydrophobic material at least at the channels and the reservoir thereof, and that becomes at least partially hydrophilic at the channels thereof upon the fluid being delivered via the channels to the reservoir.

8. The microfluidic device of claim 7, wherein the hydrophobic material of the substrate at the channels is identical to the hydrophobic material of the substrate at the reservoir.

9. The microfluidic device of claim 1, wherein the substrate is rotatable, such that rotation of the substrate causes the fluid to be delivered to the reservoir through the channels via centrifugal force, and the non-valve capillary mechanism is adapted to prevent the fluid from wicking from the reservoir back into the channels upon cessation of rotation of the substrate.

10. The microfluidic device of claim 1, wherein the microfluidic device is a microfluidic coupon device in which at least a sample and a reagent is deposited for analysis of the sample at least via assaying.

11. The microfluidic device of claim 1, wherein the channels are inlet channels via which the fluid is delivered to the reservoir, and the substrate further has formed therein one or more outlet channels via which the fluid is delivered from the reservoir.

12. A microfluidic coupon device comprising:

a substrate;

one or more reaction chambers formed within substrate and at which samples are analyzed after delivery thereto;

one or more waste reservoirs formed within the substrate, corresponding to the reaction chambers, and at least to which the samples are delivered after analysis within the reaction chambers and/or to which excess of the samples are delivered;

a network of channels to deliver the samples and/or reagents to the reaction chambers and to the waste reservoirs; and, one or more non-valve backflow-prevention mechanisms within and corresponding to the waste reservoirs to prevent the samples and/or the reagents delivered to the waste reservoirs via the channels from flowing from the waste reservoirs back into the channels, the non-valve backflow-prevention mechanisms comprising capillary media.

13. The microfluidic coupon device of claim 12, wherein at least one of the capillary media comprises a non-swelling capillary medium apart from the substrate and inserted into the waste reservoir corresponding to the non-valve capillary mechanism.

14. The microfluidic coupon device of claim 13, wherein the non-swelling capillary medium comprises a plurality of interstices smaller in relation to the channels, the samples and/or the reagents retained within the interstices of the medium inserted into the waste reservoir such that the samples and/or the reagents are prevented from wicking from the waste reservoir back into the channels, the samples and/or the reagents otherwise unabsorbed within the medium itself.

15. The microfluidic coupon device of claim 12, wherein at least one of the capillary media comprises a swelling capillary medium apart from the substrate and inserted into the waste reservoir corresponding to the non-valve capillary mechanism.

16. The microfluidic coupon device of claim 15, wherein the swelling capillary medium comprises a plurality of interstices smaller in relation to the channels, the samples and/or the reagents retained within the interstices of the medium inserted into the waste reservoir and absorbed within the medium itself such that the samples and/or the reagents are prevented from wicking from the waste reservoir back into the channels.

17. The microfluidic coupon device of claim 12, wherein at least one of the capillary media comprises one or more capillaries fabricated within the substrate itself, the capillaries smaller in relation to the channels, the samples and/or the reagents retained within the capillaries of the mechanism such that the samples and/or the reagents are prevented from wicking from the waste reservoir back into the channels.

18. The microfluidic coupon device of claim 12, wherein the substrate is of a hydrophobic material at least at the channels and the waste reservoirs thereof, and that becomes at least partially hydrophilic at the channels thereof upon the samples and/or the reagents being delivered via the channels to the waste reservoirs.

19. The microfluidic coupon device of claim 12, wherein the substrate is rotatable, such that rotation of the substrate causes the samples and/or reagents to be delivered to the reaction chambers and to the waste reservoirs via the channels via centrifugal force, and the non-valve capillary mechanisms are adapted to prevent the samples and/or the reagents from wicking from the waste reservoirs back into the channels upon cessation of rotation of the substrate.

20. A method comprising:

depositing a fluid onto a microfluidic device;

delivering the fluid via one or more channels formed within the microfluidic device ultimately to a reservoir formed within the microfluidic device; and, preventing the fluid from flowing from the reservoir back into the channels, using a non-valve backflow-prevention mechanism comprising a capillary medium, wherein the capillary medium comprises one or more of:

a non-swelling capillary medium apart from the substrate and inserted into the reservoir;

a swelling capillary medium apart from the substrate and inserted into the reservoir; and, one or more capillaries fabricated within the substrate itself, the capillaries smaller in relation to the channels, the fluid retained within the capillaries of the mechanism such that the fluid is prevented from wicking from the reservoir back into the channels.

* * * * *